US008002143B2

(12) United States Patent
Vorderkunz

(10) Patent No.: US 8,002,143 B2
(45) Date of Patent: Aug. 23, 2011

(54) INSULATED JACKET FOR A BEVERAGE CONTAINER

(75) Inventor: Tom Vorderkunz, Waco, TX (US)

(73) Assignee: Custom Printing II Ltd., Belton, TX (US)

( * ) Notice: Subject to any disclaimer, the term of this patent is extended or adjusted under 35 U.S.C. 154(b) by 745 days.

(21) Appl. No.: 11/620,383

(22) Filed: Jan. 5, 2007

(65) Prior Publication Data

US 2008/0164269 A1 Jul. 10, 2008

Related U.S. Application Data

(60) Provisional application No. 60/883,445, filed on Jan. 4, 2007.

(51) Int. Cl.
*B65D 25/00* (2006.01)

(52) U.S. Cl. ..... 220/739; 220/592.24

(58) Field of Classification Search ..... 220/62.22, 220/592.26, 903, 737, 739, 62.12, 592.24; 229/103.11, 403

See application file for complete search history.

(56) References Cited

U.S. PATENT DOCUMENTS

| | | | | |
|---|---|---|---|---|
| 4,401,245 | A * | 8/1983 | Zills | 224/148.3 |
| D276,119 | S | 10/1984 | Heweston | |
| 4,540,611 | A | 9/1985 | Henderson | |
| 4,648,525 | A | 3/1987 | Henderson | |
| 5,147,067 | A | 9/1992 | Effertz | |
| 5,256,131 | A | 10/1993 | Owens et al. | |
| 5,259,529 | A | 11/1993 | Coale | |
| D376,956 | S | 12/1996 | Sharp | |
| 6,059,140 | A | 5/2000 | Hicks | |
| 6,138,902 | A | 10/2000 | Welch | |
| 6,164,487 | A | 12/2000 | Hicks | |
| 6,286,709 | B1 | 9/2001 | Hudson | |
| D538,113 | S | 3/2007 | Maxey | |
| 2005/0001125 | A1 * | 1/2005 | Exler | 248/309.1 |
| 2008/0017654 | A1 * | 1/2008 | Chu | 220/739 |

* cited by examiner

*Primary Examiner* — Anthony Stashick
*Assistant Examiner* — Jeffrey Allen
(74) *Attorney, Agent, or Firm* — Vinson & Elkins LLP

(57) ABSTRACT

Insulated jackets for beverage containers are disclosed having a seamless, fabric-covered, finished upper edge. The insulated jackets disclosed also comprise a partially of fully fabric-covered interior surface. Also disclosed are blanks for forming the disclosed insulated jackets for beverage containers.

5 Claims, 4 Drawing Sheets

INSULATED JACKET FOR A BEVERAGE CONTAINER

CROSS-REFERENCE TO RELATED APPLICATIONS

This application claims priority to U.S. Provisional Application No. 60/883,445, filed Jan. 4, 2007.

BACKGROUND OF THE INVENTION

1. Field of the Invention

The present invention relates to jackets for insulating heated or cooled beverages, preferably conventional single-serving aluminum cans, and methods for making said insulating devices.

2. Description of Related Art

A wide variety of disposable packaging for beverages of all types are currently available to consumers. Such packaging includes aluminum cans, glass bottles and plastic bottles and can be single-serving sized (e.g. 4, 6, 8, 12, or 16 ozs.) or multiple serving sized.

While such beverage containers offer many advantages, one of the disadvantages is that the containers generally have poor insulative capabilities. Hence, chilled beverages in particular tend to rapidly gain temperature once the beverage container is taken from a chilled environment, e.g., a refrigerator, and opened for consumption.

To address this problem, a considerable number and variety of different forms of insulated devices for jacketing beverage cans have been developed over recent years to act as holders for beverage cans while being consumed, the insulative character of such devices acting to minimize heat transfer from the warmer ambient atmosphere to the chilled beverage within the container. One popular form of such devices is made of foamed synthetic thermoplastic material commonly called foam rubber, formed as a cylindrical jacket dimensioned to closely encircle a standard twelve-ounce beverage can. Such devices typically also include a circular foam rubber bottom wall to provide additional insulative properties. These are sometimes referred to as "can coolers," "koozies" or "coozies." These can coolers are generally somewhat flexible and sized to fit snugly around conventional single-serving beverage containers such as aluminum cans, or glass or plastic bottles.

While these devices function well for their intended purpose, they have certain disadvantages. The earliest can coolers were entirely constructed of synthetic foams. Later can coolers were constructed with fabric-backed sheets of synthetic foam. When the foam has a single side with a fabric backing the result is a can cooler having a fabric outer surface and exposed foam inner and edge surfaces. When the foam has a fabric backing on both sides, the resulting coolers have exposed foam only at their outer edges. However in the double-sided embodiments of the prior art, the can cooler typically uses a lower grade of fabric on the interior of the can, one that is not designed or optimized to be suitable for ornamentation.

The use of fabric on the outside of the can cooler had several advantages. It permitted alternative methods of printing on the outside of the can cooler and presented a pleasing tactile surface for a person when holding the can cooler. The use of a fabric interior made it easier to slide the can cooler on and off of a container, particularly when the surface of the container was wet with condensation. Nevertheless, methods of constructing flexible can coolers that are available to date still leave exposed foam at the edge surfaces of the cooler. The foam edge surfaces are esthetically and tactilely displeasing and are difficult to ornament by conventional printing methods. Furthermore, the exposed foam edges are prone to nicks and tears that reduce the durability of the product.

BRIEF SUMMARY OF THE INVENTION

The present disclosure provides an insulative jacket for a beverage container, comprising: (a) a main body formed of a flexible insulative material having at least one face that is fabric covered in a configuration to form an annulus having an outer surface, an inner surface, an upper edge and a lower edge, and (b) a generally circular endwall connected to the lower edge of the annulus; wherein the main body is openable into a generally annular form defining an interior area of a shape and dimension for receiving the beverage container through the upper edge, and wherein the annulus outer surface, annulus upper edge and at least a portion of the annulus inner surface are covered with a substantially continuous sheet of fabric. The insulative jacket thereby provides an opening suitable for snugly receiving a beverage container, typically a conventionally sized container, having a fabric-covered, finished upper edge.

In preferred embodiments, the endwall of the insulative jacket comprises two or more semi-circular endwall portions connected to the lower edge of the annulus at diametrically opposed locations. The annulus is formed through the use of a single seam, or alternately, through the use of two or more seams.

In further embodiments, the annulus outer surface, annulus upper edge and annulus inner surface of the insulative jacket are covered with a substantially continuous sheet of fabric. Additionally, the endwall inner surface and endwall outer surface can also be covered with the previously-mentioned substantially continuous sheet of fabric.

The disclosure also provides a blank for forming an insulative jacket for a beverage container having a circumference, comprising a generally planar web of flexible insulative material having at least one face that is covered with fabric that includes a main elongated rectangular body portion defined by: (a) opposed first edges wherein the rectangular body portion is of sufficient length to encircle the circumference of a beverage container when the first edges are abutted with one another; and (b) opposed second edges each having endwall portions extending from the opposed second edges at a spacing therealong selected to form an endwall when the rectangular body section is folded into two halves along a line parallel to the opposed second edges, the first edges of the body are abutted and the ends of the semicircular wall portions are abutted. This blank can be secured in a configuration that produces an opening suitable for snugly receiving a beverage container and having an annulus with a single seam. Furthermore the blank provides an insulative jacket having a fabric-covered, finished upper edge formed by the folded material to produce a seamless edge, and a partially or fully fabric-covered finished interior. In preferred embodiments, the blank has endwall portions that are semi-circular.

The disclosure provides an additional blank for forming an insulative jacket for a beverage container, this blank comprising a generally planar web of flexible insulative material having at least one face that is covered with fabric that includes a main elongated rectangular body portion defined by: (a) opposed first edges wherein the rectangular body portion is of sufficient length to encircle the circumference of a beverage container when the first edges are abutted with one another; (b) opposed second edges each having at least two endwall portions extending from one of the opposed second edges at a spacing therealong selected to form an endwall when the first edges of the body are abutted and the ends of the semicircular wall portions are abutted; wherein the width of the rectangular body between said opposed second edges is greater than the height of the beverage container. Again, this blank can be secured in a configuration suitable for snugly receiving a beverage container having an annulus with a single seam. When properly secured, the blank provides an insulative jacket having a fabric-covered finished upper edge and a partially fabric-covered interior. Again, in preferred embodiments, the blank has endwall portions that are semicircular.

The disclosure provides yet another blank for forming an insulative jacket for a beverage container having a circumference, comprising a generally planar web of flexible insulative material having at least one face that is covered with fabric that includes a first and second elongated rectangular body portion each defined by: (a) opposed first edges wherein each first and second rectangular body portion is of sufficient length to encircle the circumference of a beverage container when the first edges are abutted with one another; (b) and opposed second edges, wherein one of the opposed second edges of the first rectangular body portion and one of the opposed second edges of the first rectangular body portion are joined by a first endwall portion; wherein the blank forms an opening suitable for said beverage container when said first and second rectangular body portions are folded along a line parallel to the opposed second edges and the opposed first edges of the body are abutted. The disclosed blank, when properly secured, provides an insulative jacket with a fabric-covered finished upper edge, a fully or partially fabric-covered interior and an annulus having two or more seams.

In preferred embodiments, the aforementioned jacket further comprises a second endwall portion located at the opposed second edge of the first rectangular body portion opposite the first endwall portion. In other preferred embodiments, the aforementioned jacket further comprises a third endwall portion located at the opposed second edge of the second rectangular body portion opposite the second endwall portion. In further embodiments, the endwall portions are semi-circular.

Finally, the present disclosure provides a method of constructing a insulative jacket for a beverage container comprising the steps of: (a) providing the one of the aforementioned blanks, (b) folding a portion of said rectangular body or rectangular bodies along a line approximately parallel to said opposed second edges and securing the folded portion in coextensive relationship with an unfolded portion of the rectangular body; (c) securing said first edges of the rectangular body or rectangular bodies to create an annulus; and (d) securing said semicircular wall portions to create an endwall. In preferred embodiments, the endwall thusly created is circular.

BRIEF DESCRIPTION OF THE SEVERAL VIEWS OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF THE INVENTION

The ability to efficiently and inexpensively ornament can coolers is a significant feature both of the present invention and the prior art, as can coolers have been generally offered with some sort of ornamentation or message on them. Examples of such uses are can coolers that are ornamented with a company logo or contact information for use as a promotional gift, can coolers ornamented with a design or words designed to commemorate an event, can coolers ornamented with a design or words making them suitable as souvenirs, and the like. Therefore an important utility of devices of the prior art is the provision of one or more surfaces that are capable of attractively and durably taking up an ornamental design, for example by various methods of printing.

The present disclosure offers numerous advantages over the prior art. In certain embodiments the devices of the present disclosure a continuous printing surface that permits ornamentation not only of the outer surface of the can cooler but also the upper edges and the interior. In certain embodiments, the present disclosure even permits continuous patterns of ornamentation to be printed covering the outer surface, upper edge and optionally also the interior of the can cooler. In related embodiments, the can cooler of the present disclosure can be reversible, such that when turned inside out the patterns that were present on the inner surface are now on the outer surface, and vice versa. All of these advantages present numerous possibilities for can cooler ornamentation that were not available in the prior art.

Other advantages presented by embodiments of the present disclosure include increased durability of the upper edge surface of the can cooler. By eliminating exposed synthetic foam at the upper surface and replacing it with a finished edge durability is increased because the foam is no longer exposed to catch on surfaces, resulting in nicks or tears in the foam. Also it is more difficult for the fabric to fray or tear away from the upper edge producing a ragged appearance after repeated or rugged use.

A further advantage offered by embodiments of the present disclosure is that the finished upper edge presents a visually and tactilely more pleasing surface. Because can coolers are frequently held in the users hands for extended periods of time, the tactile pleasantness of the overall configuration is a significant consideration.

The device of the present disclosure is preferably fabricated from a conventional thin-walled polymeric foam material commonly referred to as synthetic foam rubber, having a textile fabric bonded to at least one face of the foam.

Figure 1:
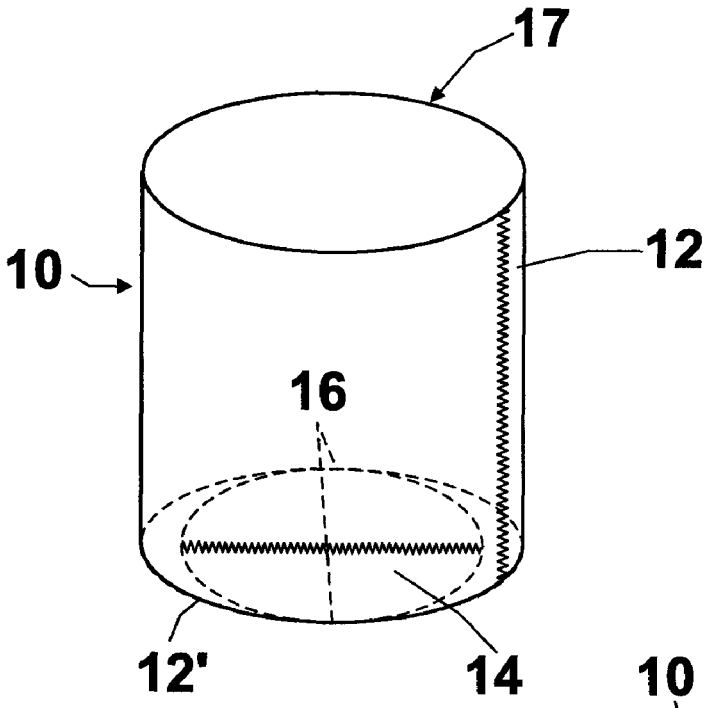
FIG. 1 is a perspective view of the improved insulated beverage container jacket, with a seamless, finished, fabric upper edge formed of folded material. The insulated jacket is shown in a partially opened condition ready for insertion of a beverage container.
Figure 2:
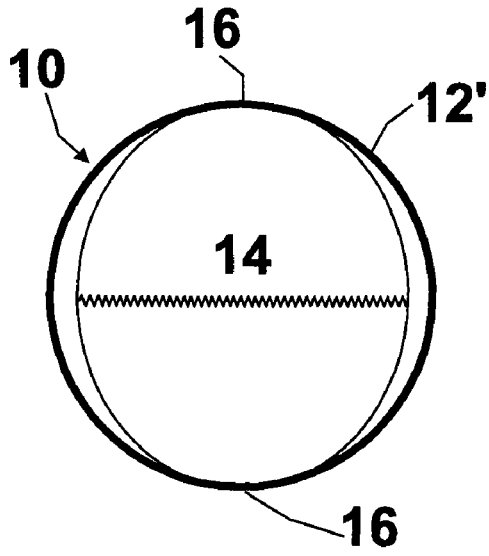
FIG. 2 is a bottom plan view of the insulated beverage container jacket of FIG. 1, also shown in the same partially opened use condition.
Figure 3:
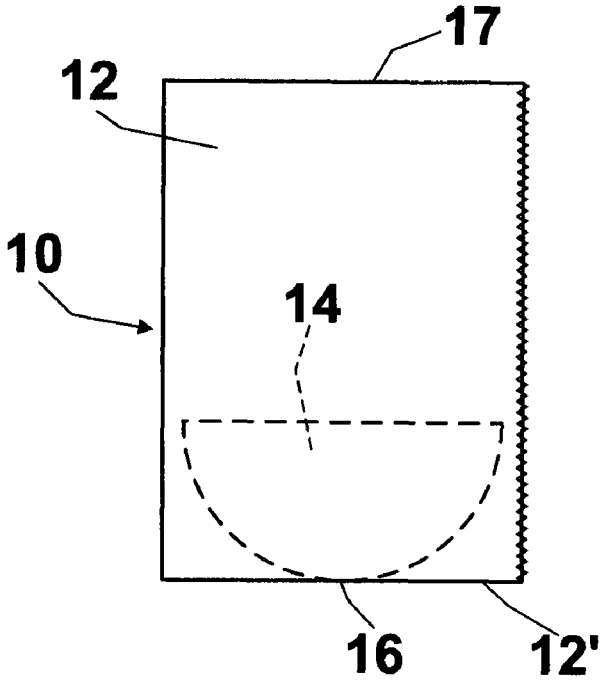
FIG. 3 is a side elevational view of the insulated beverage container jacket in accordance with a preferred embodiment of the present invention, shown in its flattened storage condition.

Referring now to FIGS. 1-3, the improved insulated beverage jacket container of the present disclosure is indicated generally at 10, shown in opened condition ready for use in FIGS. 1 and 2 and in a flattened storage condition in FIG. 3. The jacket 10 basically comprises an annular body 12 with an endwall 14 connected to the lower edge 12' of the annular body 12 at diametrically opposite locations 16 but otherwise unconnected to the annular body 12. Preferably, endwall 14 is substantially circular. Thus, in alternative embodiments the endwall 14 or any endwall of the present disclosure can connect to the lower edge 12' of annular body 12 (or any other disclosed annular body) at any suitable number of locations, e.g. 1, 2, 3, 4, or more locations. Accordingly, the bottom wall 12 can be comprised of a single integral bottom wall or of any suitable number of joined segments (e.g., a single circular wall, two semi-circular halves, etc.). If desired, the endwalls or endwall portions can be biased to fold in a particular manner when the insulative jackets of the present invention are collapsed. The beverage jacket container depicted in the figures further features a seamless, finished, fabric upper edge 17 formed of folded material. Thus the fabric covering the inner surface of annular body 12 and the outer surface of annular body 12 is a continuous sheet that is folded to form seamless upper edge 17.

In the opened condition of the jacket 10 shown in FIGS. 1 and 2, the annular body 12 assumes an essentially cylindrical shape to receive a beverage container within the interior of the annular body 12, with the endwall 14 substantially spanning the circular area within the opened lower edge 12' of the body 12 in such condition. When not in use, the jacket 10 may be folded into an essentially flattened condition shown in FIG. 3, wherein the annular body 12 assumes an essentially flattened rectangular configuration. As depicted, in the flattened configuration the circular endwall 14 is biased to fold upon itself into two face-butting semi-circular portions nested inwardly within the folded annular body 12, such that the overall folded configuration of the jacket 10 is rectangular without any significant portion of the jacket 10 projecting outwardly of the annular body 12. In alternative embodiments (not depicted), the jacket is biased to assume a flattened configuration consisting of circular bottom wall 14 folded upon itself in two back-butting semi-circular portions projecting outwardly from folded annular body 12.

Figure 4A:
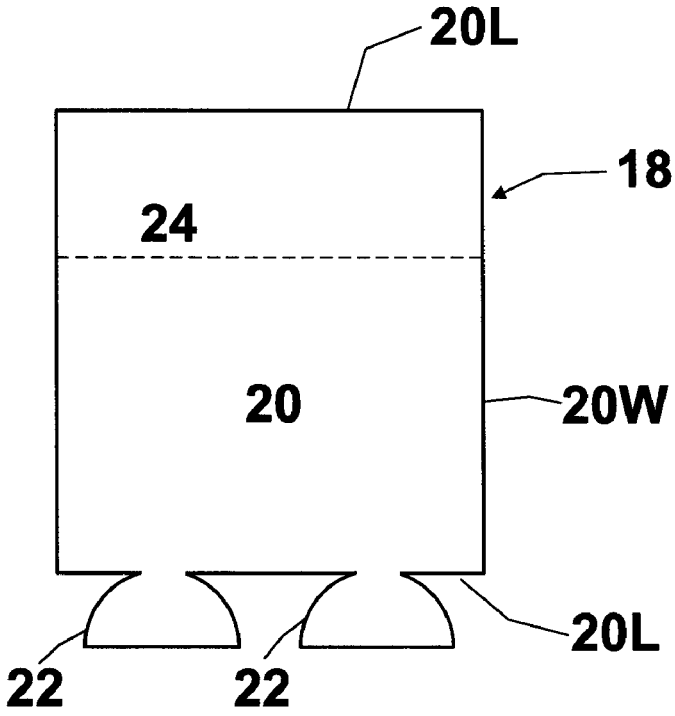
FIG. 4A and FIG. 4B are views of blanks from which the insulative jacket may be fashioned.
Figure 4B:
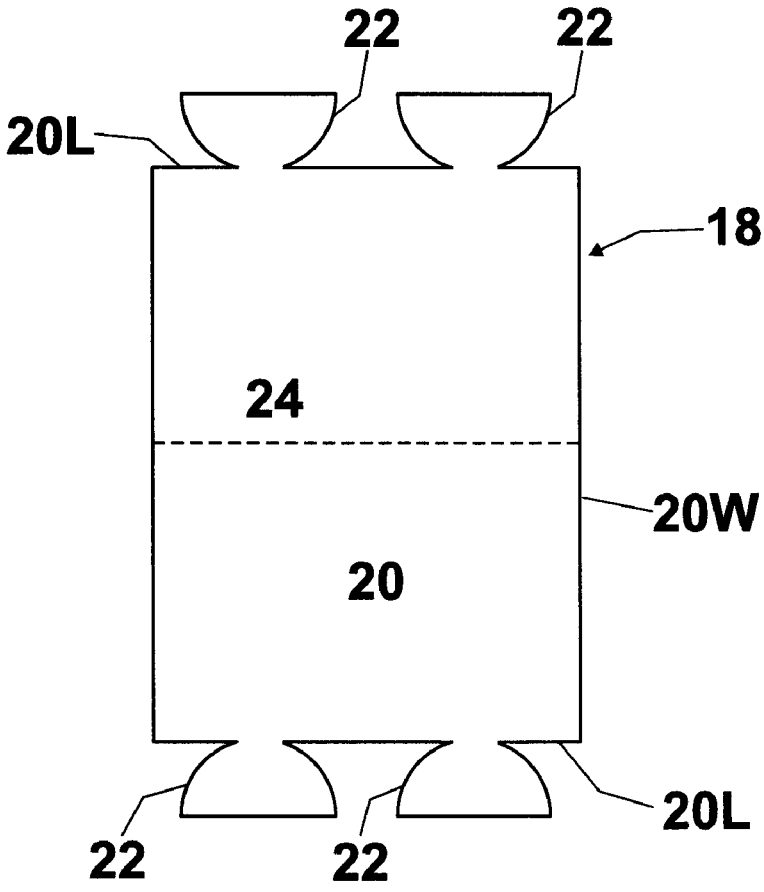

This configuration of the jacket 10 is created by fabricating the jacket 10 from the blank 18 shown in FIG. 4A or 4B. In the depicted embodiment, the jacket 10 is fabricated from a relatively thin-walled thermoplastic polymeric foam material, such as conventional synthetic foam rubber, having a textile fabric covering laminated or otherwise bonded to one of the outward surfaces of the foam material.

As shown in FIGS. 4A and 4B, the device is fashioned from a blank 18 cut from a flat web of such material into the indicated shape having a rectangular portion 20 that makes up the main body of the blank. The width 20W of the main body is approximately twice the height, i.e., axial length, of the annular body 12. The lengthwise dimension 20L of the main body is approximately equal to the circumference of the annular body 12. Two semi-circular portions 22 extend outwardly from spaced locations 16 (FIG. 1) along one lengthwise side of the rectangular portion 20 in the blank of FIG. 4A. Four semi-circular portions 22 extend outwardly from spaced locations 16 (FIG. 1) along both lengthwise sides of the rectangular portion 20 in the blank of FIG. 4B. In alternate embodiments, the endwall portions can be any suitable size and shape, and can be joined to the lengthwise side or sides of the rectangular portion at one, two, three, four, five, six or more locations with suitable spacing appropriate to the chosen embodiment.

The jacket 10 of FIG. 4B is thus fabricated from the blank 18 by folding the blank 18 at the centerline 24 to place two rectangular halves of main body 20, and the four semicircular portions are in back-to-back coextensive relationship such that fabric-covered side of the main body faces outward. The two halves are secured to one another, for example by the uniform application of adhesive to the thermoplastic polymeric foam material, by stitching or by any other suitable means of securement. In preferred embodiments the two halves of the main body are thereby uniformly secured to one another to form a structure such that there are no significant gaps between the two halves. The centerline 24 becomes a finished, seamless, folded edge. In preferred embodiments, the outer portion of the annulus and the endwall, the upper edge of the annulus and the inner portion of the annulus and some or all of the inner portion of the endwall are covered by a single substantially continuous fabric covering. The resulting jacket forms an opening suitable for receiving a beverage container having a predetermined height and circumference.

Similarly, the jacket 10 of FIG. 4A is fabricated in the same manner as the jacket 10 of FIG. 4B except that the fold line is not at the center of the main body 20 and there are no pairs of semicircular endwall portions to place in back-to-back coextensive relationship. The resulting blank has an outer portion of the endwall, outer portion of the annulus and upper edge that are covered by a single substantially continuous fabric covering. Optionally, the some or all of the inner portion of the annulus is also covered by the same single substantially continuous fabric covering.

Once the blank 18 is folded in half and the halves are secured, the lengthwise edges 20L of the folded main body 20 are juxtaposed and sewn or otherwise secured to one another at a single seam to produce annular body 12. The circular portions 22 are also juxtaposed and sewn or otherwise secured to each other to form the circular endwall 14. Essentially any conventional means of securement may be utilized, e.g., welding, gluing, sewing or the like. Seams that are thus created can be made by overlapping two pieces of material one over the other from opposite directions without folding back the edges, or by folding back the edges and butting them together to create a seam. In other embodiments, where the seams are created by butting the ends together the butted ends preferably face the jacket interior. In other embodiments, such as those designed to be reversible, the use of overlapping seams without folded edges will be preferred.

The semi-circular endwall portions 22 forming the circular endwall 14 can either project outwardly or inwardly. Jackets with inward and outward folding bottoms and methods of their construction are disclosed in U.S. Pat. No. 6,059,140, herein incorporated by reference.

In alternative embodiments, the blank can be constructed such that dimension 20 W is less than twice the length of the final annulus, and/or such that only two semicircular portions are provided. In such embodiments, the blank is folded back in coextensive relationship with at least a portion of the remaining fabric such that an annulus of an appropriate depth is created, and such that the upper edge of the annulus presents a finished, fabric-covered edge.

Figure 5A:
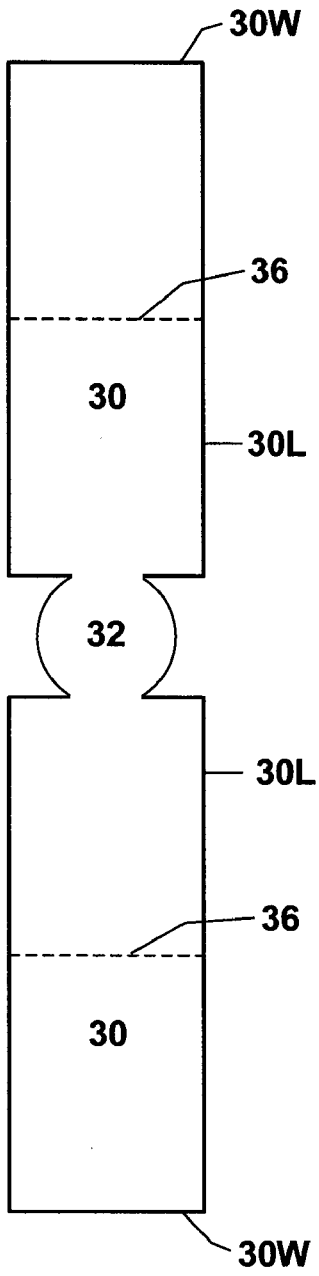
FIGS. 5A, 5B, and 5C are views of additional blanks from which the insulative jacket may be fashioned.
Figure 5B:
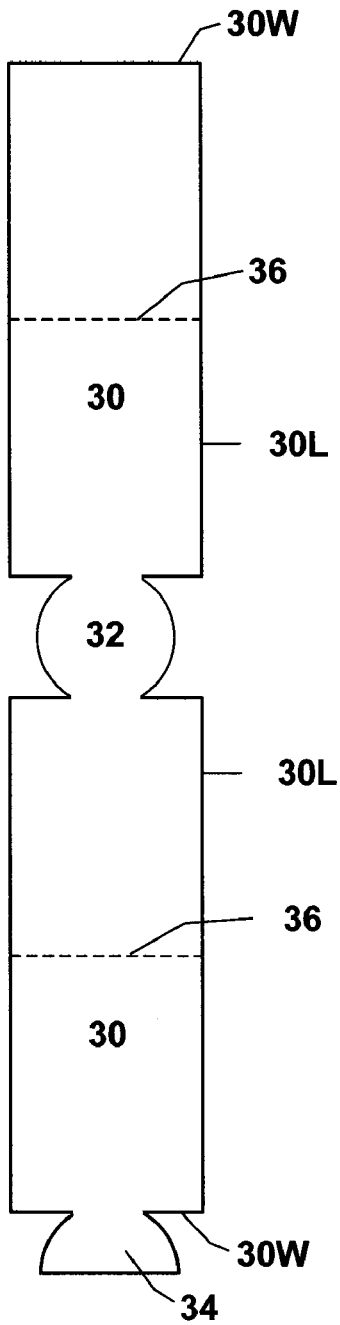
Figure 5C:
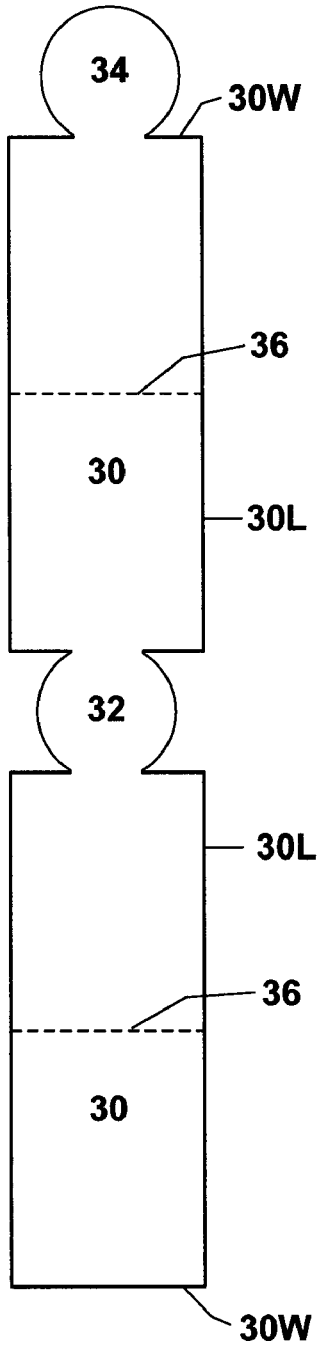
Figure 6:
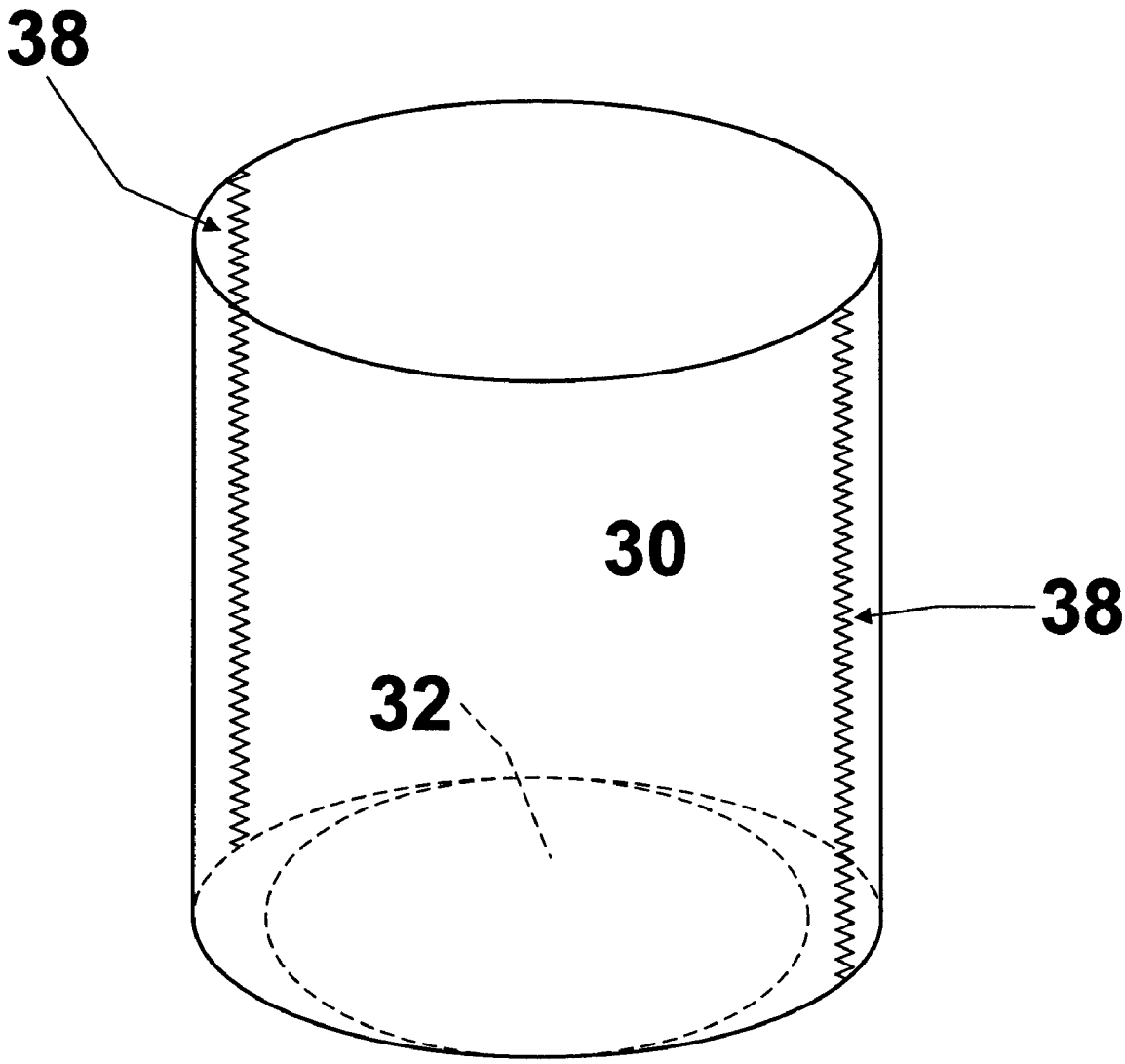
FIG. 6 is a perspective view of a finished insulative jacket with two side seams, which may be fashioned from the blanks shown in FIGS. 5A-C. The insulative jacket is shown in a partially open condition, ready for insertion of a beverage container.

In additional embodiments, the insulated jacket can be constructed such that the annular body is composed using two or more side seams. FIGS. 5A, 5B and 5C depict examples of blanks for use in such an embodiment. As with the previous embodiments, the blank is formed using a textile-covered foam material or the like. The blank of the shape indicated in FIG. 5A has two rectangular portions 30 each of length 30L and width 30W that are joined by circular portion 32. Length 30L is as long as or longer than the height of the intended beverage container, and most preferably is approximately twice the height of the final annulus. Width 30W is approximately one-half the circumference of the annulus. The jacket is assembled by folding back rectangular portions 30 at a line 36 approximately parallel to lines 30W and securing them in co-extensive relationship with the remaining portions of rectangular portions 30 such that a finished, fabric-covered upper edge of the annulus of appropriate height is created. Again, any suitable means of securement can be used, for example the uniform application of adhesive to the thermoplastic polymeric foam material, stitching or any other suitable means of securement. Edges 30L are then secured to each other by means of two side seams 38 to create the finished insulative jacket depicted in FIG. 6 forming an opening suitable for receiving a beverage container of a predetermined height and circumference. As discussed above, any suitable means of securement can be used to secure the seams.

The blank of FIG. 5A produces an insulative jacket wherein the outer endwall portion, the outer portion of the annulus and the upper edge and optionally some or all of the interior of the annulus are covered by a substantially continuous fabric covering. FIGS. 5B and 5C offer variations of the insulative jacket of FIG. 5B that further include some or all of the inner endwall as part of the substantially continuous fabric covering. FIG. 5B achieves this result by providing to endwall portions 34 at the ends of the rectangular portions 30 opposite endwall 32. FIG. 5C achieves this result by providing a single endwall or endwall portion 34 at the end of one of the rectangular portions 30 at a position diametrically opposed to endwall 32.

In alternative embodiments, the blanks can comprise additional material such that circular portion 32 is also constructed of a double-layer of textile-covered foam. Such embodiments would be particularly desirable when the jacket is intended to be reversible. Alternatively, the length of rectangular sections 30 can be less than twice the height of the desired annulus, and the excess material is folded over to create a finished, fabric covered upper edge of the annulus without providing a double layer of material throughout the body of the annulus.

What is claimed is:

1. An insulative jacket for a beverage container, comprising:

(a) a main body formed of a single sheet of flexible insulative material having at least one face that is fabric covered, where the single sheet is folded to form a double thickness rectangular portion and that further forms a cylinder by joined opposed side edges of the folded rectangular body, forming a single seam, wherein the formed cylinder is sized to encircle the circumference of a beverage container, and wherein the cylinder comprises an exterior surface and an interior surface, a top edge and a bottom edge and where a fabric covered face forms the exterior surface and the top edge of the cylinder to provide a fabric covered, finished upper edge; and (b) an insulative bottom formed at the bottom edge the cylinder, comprising opposed semicircular members each comprising an arcuate edge and a straight diameter edge, wherein each semicircular member is formed as an extension of the lower edge of the cylinder and joined to the other semicircular member at the straight diameter edges to from a circular bottom of the insulative jacket.

2. The insulative jacket of claim 1 wherein the outer surface, upper edge and inner surface of the cylinder are covered with a substantially continuous sheet of fabric glue bonded to one side of the single sheet of flexible insulative material.

3. The insulative jacket of claim 1 wherein a single, fabric covered face of the single sheet of flexible insulative material forms the inner and outer surfaces and upper edge of the cylinder, and the inner surface, and outer surface of the circular bottom.

4. The insulative jacket for a beverage container of claim 1, wherein the diameter of the circular bottom is substantially equal to the inner diameter of the cylinder.

5. The insulative jacket for a beverage container of claim 1, wherein the seam formed in the cylinder is aligned with the seam in the circular bottom effective to facilitate collapsing of the cylindrical insulative jacket into a flat configuration.

* * * * *

UNITED STATES PATENT AND TRADEMARK OFFICE

CERTIFICATE OF CORRECTION

PATENT NO. : 8,002,143 B2
APPLICATION NO. : 11/620383
DATED : August 23, 2011
INVENTOR(S) : Tom Vorderkunz It is certified that error appears in the above-identified patent and that said Letters Patent is hereby corrected as shown below:

Column 8, line 17 of the claims, after "an insulative bottom formed at the bottom edge" insert --of--.

Column 8, line 23 of the claims, after "edges to" delete the word "from" and replace with --form--.

Signed and Sealed this
Fourth Day of October, 2011

David J. Kappos
*Director of the United States Patent and Trademark Office*